US005487526A

United States Patent [19]

Hupp

[11] Patent Number: 5,487,526

[45] Date of Patent: Jan. 30, 1996

[54] MOLD DEVICE FOR FORMING CONCRETE PATHWAYS

[76] Inventor: Jack T. Hupp, P.O. Box 1206, Richmond, Tex. 77469

[21] Appl. No.: 239,045

[22] Filed: May 6, 1994

Related U.S. Application Data

[63] Continuation-in-part of Ser. No. 900,062, Jun. 16, 1992.

[51] Int. Cl.[6] ..... E01C 7/00

[52] U.S. Cl. ..... 249/2; 249/129; 249/189; 249/205; 264/33; 264/34; 264/250; 404/89; 404/93; 425/458

[58] Field of Search ..... 425/87, 458; 249/2–4, 249/6, 131, 129, 188–189, 187.1, 205, 207; 264/33, 34, 250; 404/89, 93

[56] References Cited

U.S. PATENT DOCUMENTS

| | | | |
|---|---|---|---|
| D. 5,840 | 5/1872 | Ingalls . | |
| D. 204,803 | 5/1966 | Leeth . | |
| D. 257,824 | 1/1981 | Puccini et al. . | |
| D. 257,825 | 1/1981 | Puccini et al. . | |
| D. 272,037 | 1/1984 | Puccini . | |
| D. 281,505 | 11/1985 | Larsen et al. . | |
| 1,600,787 | 9/1926 | Ardit . | |
| 1,953,657 | 4/1934 | Pierce . | |
| 2,050,299 | 8/1936 | Evers | 249/189 |
| 2,606,428 | 8/1952 | Oldfather . | |
| 2,893,098 | 7/1959 | Tilley . | |
| 3,600,773 | 8/1971 | Davis et al. . | |
| 4,026,083 | 5/1977 | Hoyt et al. . | |
| 4,078,760 | 3/1978 | Mullins . | |
| 4,105,354 | 8/1978 | Bowman . | |
| 4,131,406 | 12/1978 | Fresquez . | |
| 4,135,840 | 1/1979 | Puccini et al. . | |
| 4,231,677 | 11/1980 | Roming . | |
| 4,287,141 | 9/1981 | Russell . | |
| 4,313,689 | 2/1982 | Reinschultz . | |
| 4,354,773 | 10/1982 | Noack . | |
| 4,407,480 | 10/1983 | Trimmer et al. . | |
| 4,452,419 | 6/1984 | Saleeba . | |
| 4,510,725 | 4/1985 | Wilson . | |
| 4,609,303 | 9/1986 | Shumaker . | |
| 4,627,764 | 12/1986 | Scheiwiller . | |
| 4,773,790 | 9/1988 | Hagenah . | |
| 4,776,723 | 10/1988 | Brimo | 404/89 |
| 4,828,426 | 5/1989 | Hendricks et al. . | |
| 4,838,728 | 6/1989 | McKeever . | |
| 4,921,372 | 5/1990 | Hybertson . | |
| 5,051,023 | 9/1991 | Yoshida et al. . | |
| 5,211,895 | 5/1993 | Jacklich, Sr. . | |

FOREIGN PATENT DOCUMENTS

| | | | |
|---|---|---|---|
| 2208883 | 4/1989 | United Kingdom | 404/93 |

OTHER PUBLICATIONS

Basic Masonry Illustrated, 1981, Lane Publishing Co., Menlo Park, CA, pp. 76–77.

R. J. DeCristoforo, Handyman's Guide to Concrete and Masonry, Reston Publishing Co., Inc., Reston, VA, 1978, pp. 183–189.

R. J. DeCristoforo, Handyman's Concrete and Masonry Handbook, Arco Publishing Co., Inc., NY, 1962, p. 70.

Color Tile advertisement, Royal Rock ceramic tile, Houston Post, Jan. 14, 1990.

(List continued on next page.)

*Primary Examiner*—Jay H. Woo
*Assistant Examiner*—Joseph Leyson
*Attorney, Agent, or Firm*—Gunn & Associates

[57] ABSTRACT

The present invention is directed to a mold for forming concrete walkways or surfaces. The mold incorporates a plurality of openings for receiving concrete therein. The mold forms a single concrete slab having a simulated brick or rock pattern on it's surface. Concrete walkways are formed by placing the mold of the invention on a surface and pouring concrete in the openings. Upon removal of the mold, the concrete retains the pattern. The procedure is repeated to form a walkway of a desired length, width and configuration.

16 Claims, 3 Drawing Sheets

OTHER PUBLICATIONS

Backyard Brickwork . . . 3 sheets literture, 1989, M. Lawrence.
1 sheet Drawing No. 7122262 . . . Jun. 9, 1971, Germany.
Brickform Patterns . . . 1 sheet, undated.
Brickform Tools . . . Texture Mats . . . 4 sheets, commercial literature, undated.
Uni–Group U.S.A. . . . Manufactures of Uni Paving Stones The Original. The Best . . . 4 sheets of literature, undated.
Lasting Impressions In Concrete, Inc. . . . 6 sheets of literature, undated.
Bomanite Corporation . . . Leadership A reputation for excellence, Innovation & Experience . . . 4 sheets literature, undated, Madera, CA.
Brickform Texture Mats . . . 1 sheet, undated.
Creteprint . . . Pattern Imprinted Concrete . . . 9 sheets literature, undated.
Bonden Beläge . . . 3 sheets literature, undated.
Manuale Per LaCostruzione Di Pavimenti Di Pietra . . . 5 sheets literature, 1977.

MOLD DEVICE FOR FORMING CONCRETE PATHWAYS

RELATED APPLICATIONS

This application is a continuation-in-part application of the applicant's prior U.S. patent application Ser. No. 07/900,062 filed Jun. 16, 1992.

BACKGROUND OF THE DISCLOSURE

The present invention is directed to an apparatus for forming concrete pathways, particularly, a plastic mold for configuring geometric designs for sidewalks, patios, gardens and the like.

The formation of sidewalks or concrete pathways typically requires excavation of a pathway, the assembly of wooden or metal forms which normally are required to restrain the sides of the concrete after pouring and then disassembly of the wooden or metal forms once the concrete has cured. Thus, conventional concrete forming methods are costly both in terms of labor and materials.

Concrete forming devices known in the prior art employ a mold to form the concrete to a desired shape. As the concrete begins to cure, the mold is removed and the next concrete member or section is formed. The use of such mold devices allows concrete sections of relatively uniform shape to be continuously formed having the cross-sectional configuration of the mold. Such prior art devices include U.S. Pat. No. 2,893,098 to Tilley which discloses a mold for applying simulated masonry to walls and the exterior surfaces of buildings. U.S. Pat. No. 3,600,773 to Davis discloses a concrete forming device of rather complex construction. A mold component of the device includes movable lower side edge portions which are resiliently biased downwardly to accommodate surface irregularities for confining the concrete in the mold.

U.S. Pat. No. 4,287,141 to Russell discloses an apparatus for forming embankments of trapezoidal shape. The trapezoidal-shaped shield apparatus is opened at the top and bottom, and rearwardly. Concrete is introduced into the top of the shield for forming each segment of the embankment.

U.S. Pat. No. 4,407,480 discloses a concrete form having an embossed forming panel for molding a facade of brickwork in a particular pattern on a concrete wall. The embossed panels are supported by a reinforcing gridwork in order to prevent buckling under the weight of a volume of poured concrete.

U.S. Pat. 4,354,773 to Noack discloses a simulated interlocking stone paving block. The concrete paving blocks are formed with a mold. U.S. Pat. No. 4,609,303 to Schumaker discloses an apparatus for forming concrete pathways. The apparatus continuously moves along the path as concrete is poured through a hopper extending upwardly from the top of the apparatus.

As noted in U.S. Pat. No. 4,609,303 a critical problem with prior art slip-forming devices used in the construction of concrete pathways is that the concrete that is discharged from such devices tends to crack or fracture. The tendency to crack during setting is particularly acute in applications requiring a concrete aggregate that contains an amount of water sufficient to insure the formation of a smooth surface as the concrete member is being discharged from the form. Frequently, an entire concrete section must be removed and repoured due to the cracking and/or fragmentation following setting.

U.S. Pat. No. 4,105,354 to Bowman discloses a pattern forming wheel for imprinting predetermined surface patterns upon uncured concrete surfaces. The wheel is comprised of a frame and a plurality of rigid, wedge-shaped blades which are pressed into fresh, smooth concrete still in the forms.

Similarly, U.S. Pat. No. 4,131,406 to Fresquez and U.S. Pat. No. 4,231,677 to Roming disclose tools for making impressions in wet concrete. The impressions are formed by blades arranged in a pattern which includes the simulation of brick.

The concrete forming apparatus of the present invention overcomes the disadvantages of the prior art devices by providing a mold to rapidly (usually within two minutes) form an entire section of concrete in place comprising a plurality of molded concrete shapes set apart by deep, interconnected grooves. The mold can be used repeatedly in a straight line or over a wide area to create a walkway or pathway. As used herein, the term "walkway" or "pathway" includes patios, driveways, sidewalks, and the like.

The mold of the present invention is configured such that at least one side of the apparatus will always sit flush or interlink with a previously formed section to provide for an apparently seamless and unbroken association between the new section and the previously formed section. The grooves between the molded concrete shapes may be filled with sand, earth or some other material of the same or different color. Each of the individually molded slabs can be bound to an adjacent, previously formed slab if accomplished before the concrete sets up. The binding process is accomplished by removing the form immediately after filling each opening with concrete, distributing a small amount of concrete in the gap between the first and second slabs, refinishing the connecting joint or replacing the mold, and applying downward pressure to the mold thereby distributing the added concrete evenly throughout the gap and binding each of the slabs together at their lower extremity. Binding of each slab can also be accomplished by evenly spreading a layer of concrete on the surface of the ground prior to placing the mold and filling its cavities in the conventional manner.

SUMMARY OF THE INVENTION

The present invention is directed to a mold for forming a concrete walkway. The mold comprises perimeter sidewalls having top and bottom edges and a plurality of interconnecting beams having top and bottom edges. The sidewalls and the interconnecting beams circumscribe a plurality of brick or rock shaped openings for forming a concrete slab. The top edge of each sidewall and each beam define a continuous surface over which the concrete can be troweled smooth. The bottom edge of each interconnecting beam is raised a distance above the bottom edge of the sidewalls to allow communication of the concrete between the openings and produce a unitary slab.

BRIEF DESCRIPTION OF THE DRAWINGS

So that the manner of achieving the above recited features and advantages of the present invention can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
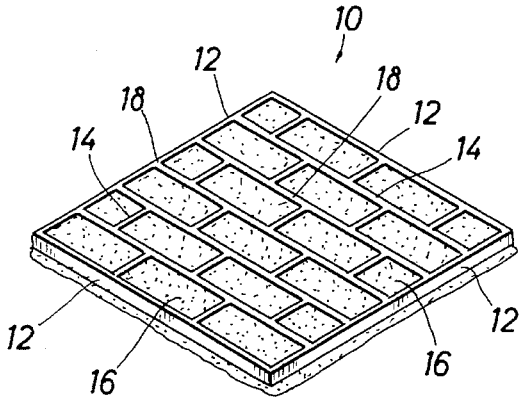
FIG. 1 is a plan view of the mold with concrete filling each of the openings.

Referring first to FIG. 1, the concrete mold of the present invention is generally identified by the reference numeral 10. The mold comprises perimeter sidewalls 12, which wrap around the entire mold, and a plurality of interconnecting members or beams 14. The sidewalls 12 and beams 14 define a series of openings 16 through which concrete is poured. The speckled surface appearing within the openings 16 in FIG. 1 is concrete. The sidewalls 12 and beams 14 have a substantially horizontal, top edge 18 which defines the upper exposed face or continuous surface of the mold that allows the concrete to be troweled smooth and flush with the top edge 18. In this plan view, the mold 10 is shown as it would appear after pouring concrete in each of the openings 16.

The sidewalls and beams may be configured to leave openings that are different or substantially identical in shape. To achieve a brick-like appearance, it is preferred that the openings have an identical, rectangular shape and be arranged in a pattern including Flemish-bond, running bond, stacked, herringbone and basket weave. Such patterns are well known in the art. The mold 10 in FIG. 1 is configured to produce a running bond brick pattern.

Figure 2:
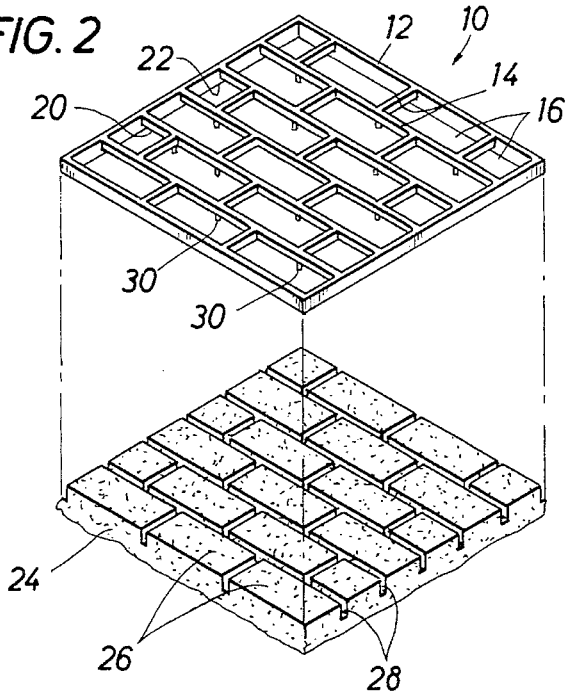
FIG. 2 is an exploded plan view of FIG. 1, showing the finished concrete pattern produced by the mold after the mold has been lifted and removed.

Referring now to FIG. 2, the mold 10 is shown after being removed from the concrete. This view more clearly shows the openings 16 defined by the sidewalls 12 and beams 14. Each of the beams 14 has a bottom edge 20 which is raised a distance above the bottom edge 22 of the sidewalls 12. In other words, the sidewalls 12 are deeper than the beams 14 and define the boundaries of the mold. When concrete is poured into the openings 16, it spreads across the earth or other surface below the mold within the entire area defined by the perimeter side walls 12. In this manner, a single, unitary slab 24 is formed having certain protrusions 26 formed by the openings 16.

Another feature of the present invention is the use of support legs 30 which downwardly depend from the bottom edge 20 of beams 14. While certain applications may not require such a support leg, it is preferred that there be at least one of the legs 30 and that they be spaced evenly throughout the area defined by the perimeter walls 12. The support legs 30 rest against the earth or other surface below the mold to prevent flexing of the beams during the troweling of the concrete. Beams that are allowed to flex under moderate pressure can cause an uneven walkway or patio.

It should be noted that the height of the protrusion 26 or the depth of the grooves 28 therebetween is determined by the height of beams 14. The height of the beams may be uniform throughout the mold or it may vary, for example, to better allow for drainage of rain water. Likewise, it is the height of the sidewalls 12 which determines the thickness of the entire slab.

Figure 3:
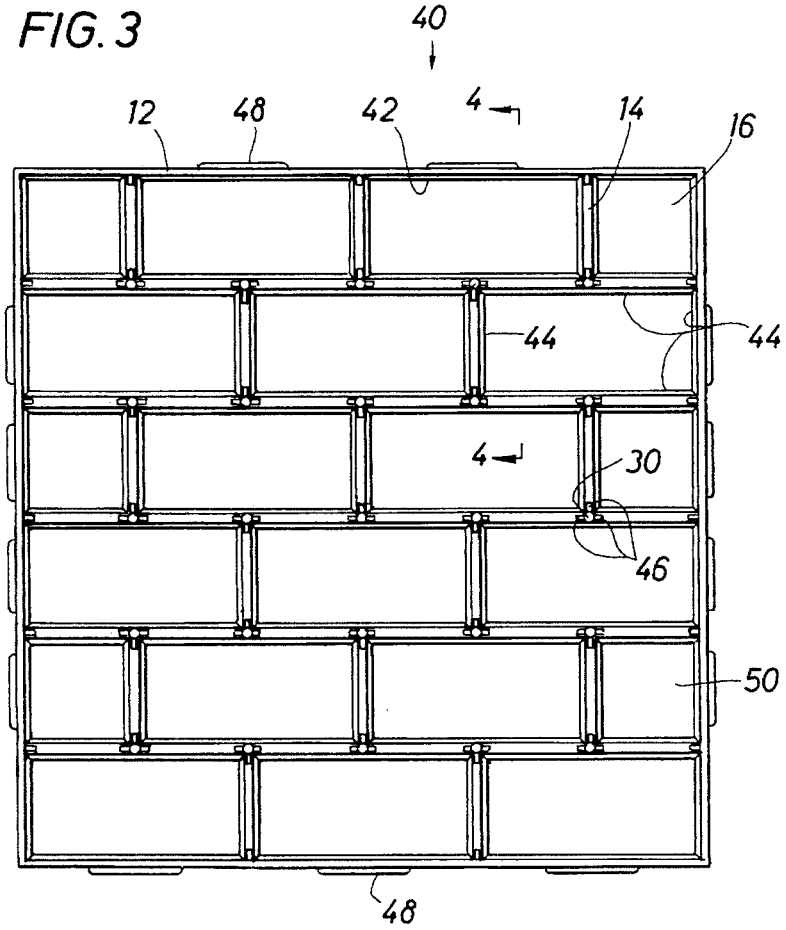
FIG. 3 is a schematic view of the bottom of the mold.

Now referring to FIG. 3, a schematic, bottom view of the mold 40 is shown. The mold 40 has perimeter sidewalls 12 and interconnecting beams 14 as does the mold 10 in FIGS. 1 and 2. However, mold 40 has additional detail or elements which make the mold easier to use and more durable. For these reasons, mold 40 is the preferred embodiment of the present invention.

The sidewalls 12 and beams 14 of mold 40 define a plurality of openings 16. It is preferred that the inner surface 42 of the perimeter sidewalls 12 and both sides of each beam 14 have a flared portion 44 along the top edge 18. The flared or Y-shaped portion 44 is illustrated most effectively in FIG. 4 where a cross-section is shown of the sidewall 12 and beams 14. One purpose for having the flared portion 44 is to produce a brick-shaped protrusion with no sharp edges that will easily chip or break. The flared portion 44 also makes the mold 40 easier to remove from the freshly poured concrete. However, in some cases it may still be necessary or desirable to touch up or repair the edges of a brick-like protrusion.

Figure 4:
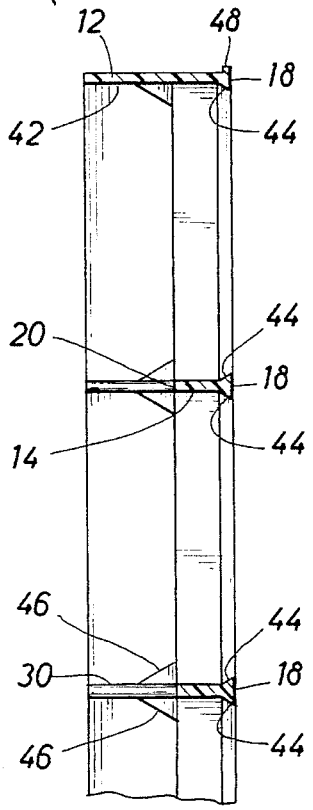
FIG. 4 is a sectional view of the mold taken along line 4—4 of FIG. 3.

Also in FIG. 3, the support legs or pegs 30 are shown extending below the beams 14 and being supported by webbing 46. The webbing 46 provides lateral support to legs 30 so that the legs will not bend or break off. As shown in the embodiment of FIG. 3, legs 30 are preferably located at each intersection of beams 14. The webbing 46 extends from the leg 30 along each of the surrounding beams 14 and has a width that is less than or equal to the width of the beam. As shown in FIG. 4, it is preferred that the webbing 46 extend downward less than half the length of the leg 30. It is also preferred that similar webbing be incorporated where each beam 14 is attached to the sidewall 12.

Still referring to FIG. 3, handles or tabs 48 may be provided at various points around the outside of the perimeter sidewalls 12. It is preferred that tabs 48 be used around the entire perimeter or, in the case of a square mold, on each side of the mold in order to conveniently lift the mold evenly in an upward, translational movement. It should be noted that handles attached to the top of the mold are within the scope of the invention, but are not preferred since they may interfere with the troweling process. The tabs 48 preferably extend horizontally from the top of the sidewall 12 only a very short distance so that they will not interfere with, or cause damage to, previously poured and immediately adjacent slabs.

It is preferred that the mold of the present invention be made of rigid plastic in order to minimize it's weight. The outside dimensions of the mold 40 are preferably about 2 feet by 2 feet with a height of approximately 1½ to 2½ inches. It is also preferred, but not required, that the mold 40 be substantially planar and have straight sidewalls 12, as shown in FIGS. 1–4. It is understood however that the mold 10 may be formed with an irregular profile or perimeter and have greater or lesser dimensions.

The interconnecting beams 14 enclose and define the depth of the protrusions 26 below the exposed upper surface 18 of the mold 10. The bottom edge 20 of the beams 14 are-relatively flat. The width of beams 14 are determined (approximately ¼ to ½ inch in width) to approximate the customary distance between laid brick, preferably about ½ inch in width. The rib members or beams 14 may taper upwardly and outwardly from the bottom edge 20 and merge with the horizontal planar surfaces 18 of the interconnecting members 14 for forming raised concrete protrusions 26 which are curved about the perimeter thereof while having a common slab below. The beams 14 are substantially Y-shaped in cross-section as shown in FIG. 4. The Y-shaped configuration of the beams 14 aid the mold 10 to form protrusions 26 which are beveled about the perimeter thereof so that the tendency of the concrete protrusions to crack or fracture when the mold 10 is removed is virtually eliminated.

The perimeter sidewalls 12 of the mold 10 have a profile which is the reverse of the opposite side of the mold 10 so that each section of a pathway formed by the mold 10 will abut or interlink with a previously formed concrete section. When the mold is square, as is mold 40 shown in FIG. 3, the opposite sides are straight and the mold abuts the previously poured slab. Where a running bond pattern is used to produce a narrow path, it is preferred that the mold 40 be oriented with each course of simulated brick running perpendicular to the direction of the path. This orientation provides a natural, seamless appearance in the brick pattern between adjacent slabs.

Figure 5:
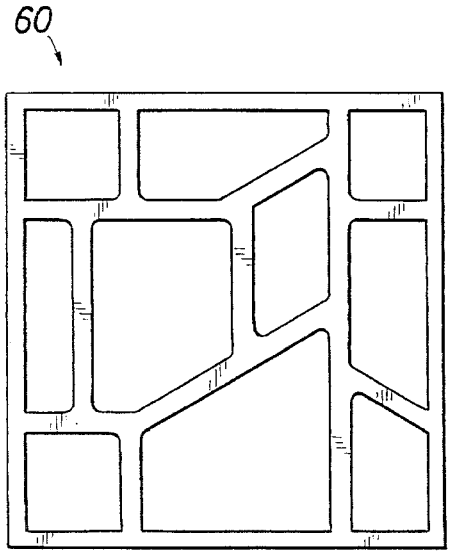
FIG. 5 is a top view of a mold having a slate pattern.
Figure 6:
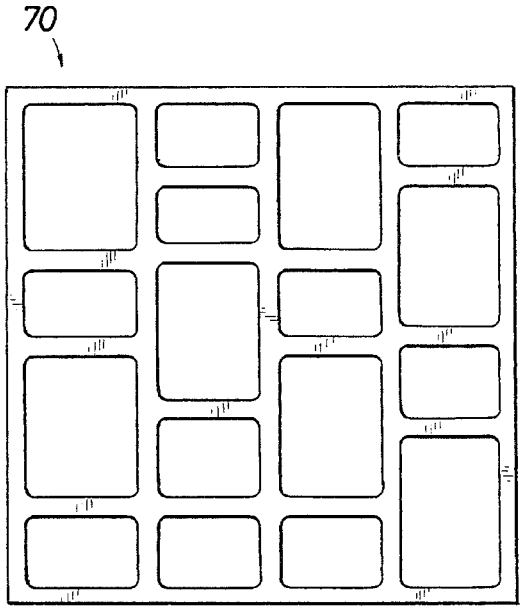
FIG. 6 is a top view of a mold having a cobblestone pattern.
Figure 7:
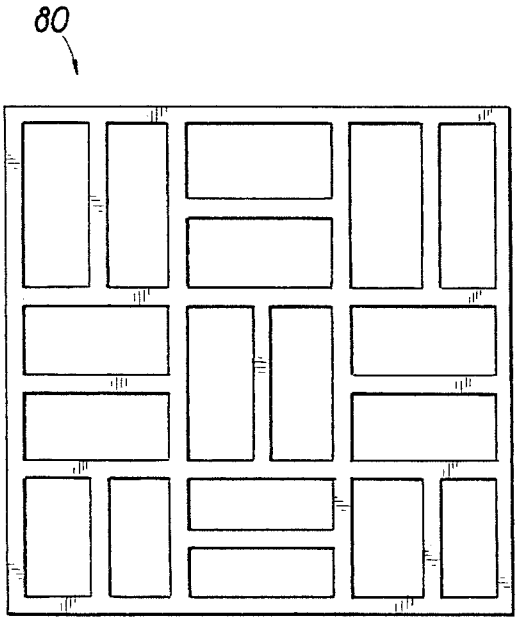
FIG. 7 is a top view of a mold having a basketweave brick pattern.
Figure 8:
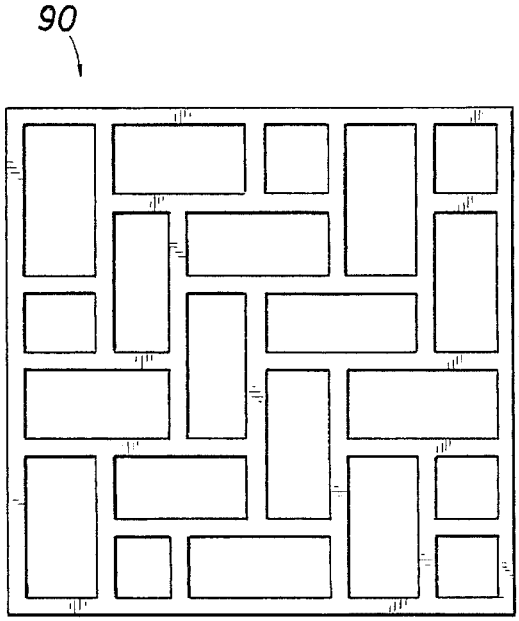
FIG. 8 is a top view of a mold having a herringbone brick pattern.

Alternative patterns may be incorporated into the mold of the present invention to achieve a variety of appearances. Mold 60 in FIG. 5 produces a slab with a series of polygon sections which simulate a slate rock pattern. Mold 70 in FIG. 6 has an irregular cobblestone appearance. Mold 80 in FIG. 7 is fashioned in a basketweave pattern of standard size bricks. Mold 90 in FIG. 8 is another brick pattern referred to as herringbone. Each of the molds in FIGS. 5–8 may be used in the same manner as described above for molds 10 and 40 of FIGS. 1–4.

Figure 9:
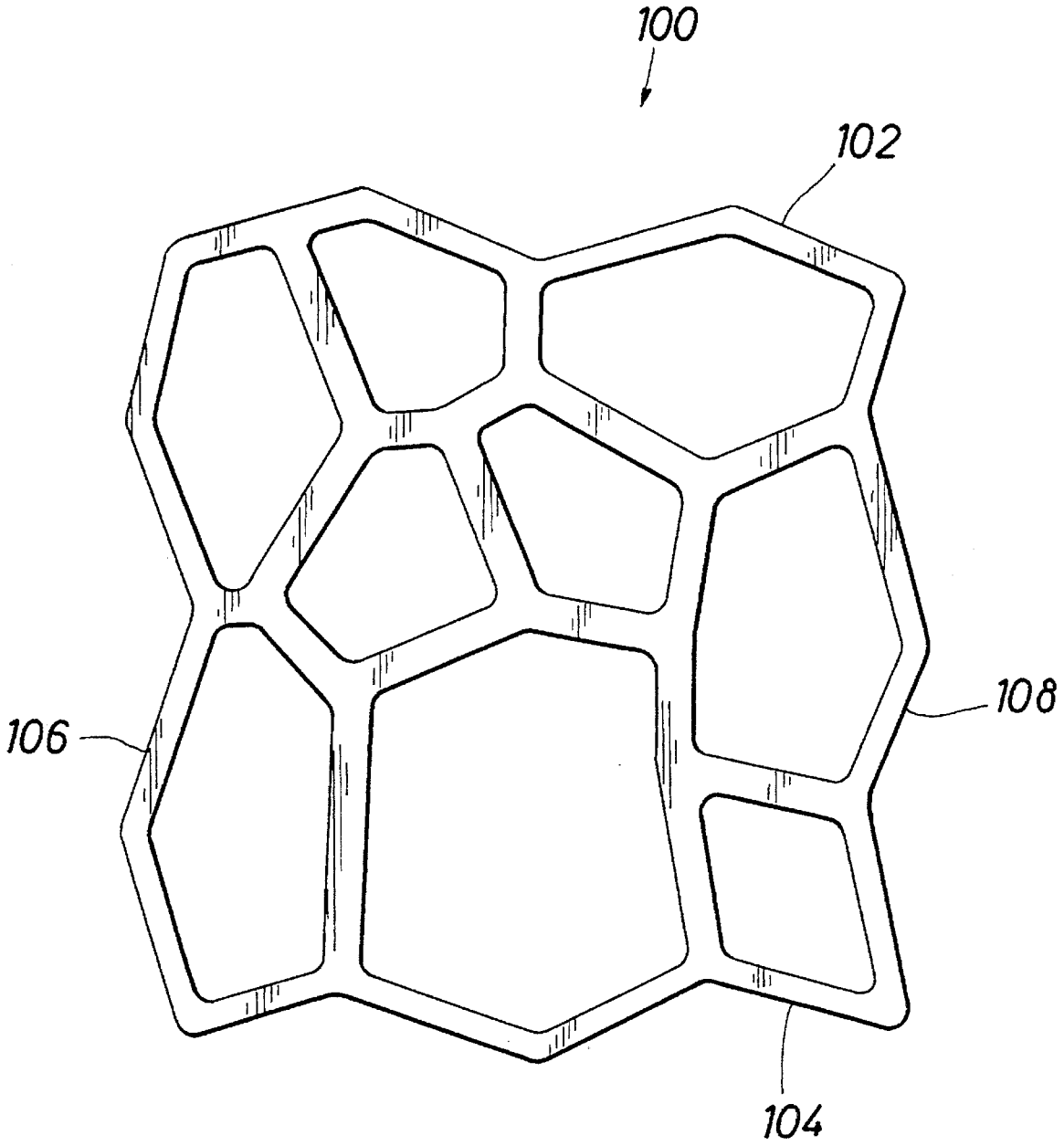
FIG. 9 is a top view of a mold having an irregular profile or perimeter which interlocks with its opposite side.

The mold 100 of FIG. 9 has an irregular profile or perimeter and forms several irregular polygons. A first sidewall member 102 and a second sidewall member 104, which are on opposite sides of the mold 100, are complimentary in the sense that the edge of a first concrete slab produced by side 102 will interlock with the edge of a second concrete slab subsequently produced by side 104. Restated, sidewall 102 is substantially the reverse of the opposite sidewall 104 for interlinking different segments of the concrete pathway end to end.

In the mold 100, even the third and fourth sides 106 and 108 are irregular and complimentary. The advantage of producing a pathway with mold 100 is that the break or void between slabs is less apparent since it is irregular like the shapes created. It is within the scope of the present invention that the complimentary sides be adjacent, if desired.

Using any of the molds in FIGS. 1–9 to form a concrete pathway is relatively simple and convenient. For example, the mold 10 is placed directly on any relatively flat surface. It will automatically configure the concrete to the existing base. For professional results, removal of about one inch of top soil and leveling of the mold 10 before filling the openings 16 with concrete may be desirable. The top soil removed may be utilized later to fill in around the sides of the concrete pathway when it has been completed.

It is recommended that one gallon of water be mixed with one 80-pound bag of pre-mix cement. The cement should be thoroughly mixed until a plastic-like consistency is reached. If additional water is required, one cup at a time is added until the correct consistency is attained. Thereafter, the concrete should be poured into the mold through each of the openings to the level of the upper surface 18 of the mold 10. The surface or edges of the concrete protrusions 26 may be smoothed with a trowel if desired. After the concrete cures sufficiently to hold it's shape, the mold is slowly lifted straight up, leaving a completed slab or section.

The mold 10 is configured such that the sides thereof may closely abut a previously formed slab to provide for an apparent seamless unbroken association between the new slab and the previously formed slab of the walkway. The individual slabs 24 created by the mold 10 may remain separated from and independent of each other with earth or some other material utilized as a stabilizer. In the alternative, adjacent slabs 24 may be bound together as a unit if accomplished before the concrete sets up.

The binding process is accomplished by removing the mold 10 immediately after filling with concrete, distributing a small amount of concrete between the current and previous slabs, and refinishing the connection or replacing the mold 10 and applying downward pressure to the mold 10 thereby distributing the added concrete evenly throughout the gap between adjacent slabs at its lower extremity. Binding of each slab 24 can also be accomplished by evenly spreading a layer of concrete on the surface of the ground prior to placing the mold 10 and filling its openings 16 in the conventional manner.

While the invention herein is described in what is presently considered to be a practical preferred embodiment thereof, it will be apparent that many modifications may be made within the scope of the invention, which scope is to be accorded the broadest interpretation of the appended claims so as to encompass all equivalent methods and apparatus.

I claim:

1. A mold for forming a concrete surface, comprising:

perimeter sidewalls having top and bottom edges; and a plurality of interconnecting beams having top and bottom edges;

wherein said sidewalls and said interconnecting beams circumscribe a plurality of openings for forming a concrete slab, the top edges of said sidewalls and said interconnecting beams defining a continuous surface, and wherein said interconnecting beams extend downwardly from said continuous surface a distance less than said sidewalls, and further including at least one support leg downwardly depending from said interconnecting beams.

2. The mold of claim 1 wherein said sidewalls define a perimeter which is substantially square.

3. The mold of claim 1 wherein said openings are substantially identical in shape.

4. The mold of claim 1 wherein said plurality of openings are a series of rectangular openings.

5. The mold of claim 1 wherein the openings resemble a slate rock pattern.

6. The mold of claim 4 wherein the series of rectangular openings resemble a running bond brick pattern.

7. The mold of claim 4 wherein the series of rectangular openings resemble a basketweave brick pattern.

8. The mold of claim 4 wherein the series of rectangular openings resemble a herringbone brick pattern.

9. The mold of claim 4 wherein the series of rectangular openings resemble a cobblestone pattern.

10. The mold of claim 1 wherein said interconnecting beams taper upwardly and outwardly from the lower edge thereof and merge with the continuous surface for forming raised concrete sections which are curved about the perimeter thereof while having a common slab below.

11. The mold of claim 1 wherein said interconnecting beams are substantially Y-shaped in cross-section.

12. The mold of claim 1 wherein said continuous surface is flat.

13. The mold of claim 1 wherein said perimeter sidewalls have an irregular profile.

14. The mold of claim 1 wherein said mold includes opposite sidewall members defining a profile which is substantially the reverse of the opposite sidewall members for interlinking different segments of the concrete pathway end to end.

15. The mold of claim 14 wherein said plurality of openings are a series of rectangular openings.

16. The mold of claim 14 wherein said plurality of openings are a series of irregular polygon openings.

* * * * *